United States Patent [19]

Tsukada et al.

[11] Patent Number: 5,024,541

[45] Date of Patent: Jun. 18, 1991

[54] MANUALLY OPERABLE SWEEPING-TYPE PRINTING APPARATUS

[75] Inventors: Shuya Tsukada, Tachikawa; Nobuyuki Mochinaga, Kunitachi; Yasuo Kanoe, Tanashi, all of Japan

[73] Assignee: Casio Computer Co., Ltd., Tokyo, Japan

[21] Appl. No.: 474,626

[22] Filed: Jan. 30, 1990

Related U.S. Application Data

[63] Continuation of Ser. No. 182,187, Apr. 15, 1988, abandoned.

[30] Foreign Application Priority Data

| | | | |
|---|---|---|---|
| Apr. 17, 1987 | [JP] | Japan | 63-57515[U] |
| Apr. 20, 1987 | [JP] | Japan | 63-58649[U] |
| Apr. 20, 1987 | [JP] | Japan | 63-58652[U] |
| May 7, 1987 | [JP] | Japan | 63-109701 |
| May 8, 1987 | [JP] | Japan | 63-67931[U] |
| May 8, 1987 | [JP] | Japan | 63-67932[U] |

[51] Int. Cl.[5] ..... B41J 3/36

[52] U.S. Cl. ..... 400/88; 400/120

[58] Field of Search ..... 400/88, 120, 233, 693; 346/76 PH, 143; 358/296, 294, 285, 293; 382/59

[56] References Cited

U.S. PATENT DOCUMENTS

| | | | |
|---|---|---|---|
| 3,541,248 | 11/1970 | Young | 178/6.6 |
| 3,973,111 | 8/1976 | Washizuka et al. | 100/88 |
| 3,993,865 | 11/1976 | Browne et al. | 358/285 |
| 4,342,520 | 8/1982 | Isake et al. | 400/233 |
| 4,461,150 | 2/1987 | Matsura et al. | 346/76 PH |
| 4,523,235 | 6/1985 | Rajchman | 400/88 |
| 4,549,825 | 10/1985 | Fish, III et al. | 400/693 |
| 4,586,838 | 5/1986 | Hara et al. | 400/693 |
| 4,609,295 | 9/1986 | Shimodaira | 346/143 |
| 4,626,925 | 12/1986 | Toyoda | 258/285 |
| 4,652,937 | 3/1987 | Shimura et al. | 358/294 |
| 4,717,965 | 1/1988 | Mashiko et al. | 358/294 |
| 4,750,049 | 6/1988 | Murakami | 346/76 PH |
| 4,785,357 | 11/1988 | Dreyfus | 382/59 |
| 4,819,083 | 4/1989 | Kawai et al. | 358/296 |
| 4,851,896 | 7/1989 | Moranaga et al. | 358/296 |
| 4,868,676 | 9/1989 | Matsuura et al. | 358/296 |

FOREIGN PATENT DOCUMENTS

| | | | |
|---|---|---|---|
| 0183980 | 6/1986 | European Pat. Off. | 400/88 |
| 201890 | 11/1984 | Japan | 400/233 |
| 280957 | 12/1986 | Japan | 400/88 |
| 225371 | 10/1987 | Japan | 400/88 |
| 257877 | 11/1987 | Japan | 400/233 |

*Primary Examiner*—Edgar S. Burr
*Assistant Examiner*—John S. Hilten
*Attorney, Agent, or Firm*—Frishauf, Holtz, Goodman & Woodward

[57] ABSTRACT

A manually operable sweeping-type compact printer apparatus has an input section, a display section, an electric circuit section, and a printer unit. All these components are incorporated in a housing. The printer unit includes a print head, rollers, an encoder, and a ribbon take-up device—all attached to a chassis which is fixed within the housing. When an operator holds the printer apparatus and moves it across a recording medium, while keeping the rollers and the print head in contact with the medium, the print head prints data on the recording medium.

18 Claims, 9 Drawing Sheets

MANUALLY OPERABLE SWEEPING-TYPE PRINTING APPARATUS

This application is a continuation of application Ser. No. 07/182,187, filed Apr. 15, 1988 now abandoned.

BACKGROUND OF THE INVENTION

1. Field of the Invention

The present invention relates to a manually operable sweeping-type printing apparatus for printing data on a recording medium while being manually moved across the medium.

2. Description of the Related Art

A manually operable sweeping-type printing apparatus is disclosed in U.S. Pat. No. 3,767,020 issued to Rowe on Oct. 23, 1973, entitled "Manually Positionable Automatic Printer." This printer comprises a hand-held housing and other components located within the housing, such as a print head, a roll of ink ribbon, a roller, an encoder, and a ribbon take-up shaft. The roller rotates, while being held in contact with a recording medium, as the housing is swept across the medium to print data on the medium. The encoder detects the rotation of the roller, thereby to determine the distance the housing has moved over the recording medium.

As the housing is moved over the recording medium, with the roller kept in contact with the medium, the roller rotates. The encoder detects the rotation of the roller, and outputs a pulse every time the roller rotates by a predetermined angle. The pulse signal output by the encoder and consisting of such pulses, therefore, represents the distance the housing has been swept across the recording medium. In synchronism with these pulses, the print head is driven to print data on the medium, by using the ink ribbon.

Such a printing apparatus must satisfy three essential requirements. First, it must be small enough that it can be comfortably held by any user. Secondly, it must be able to print data of a high print quality, regardless of the level of skill of the operator. Thirdly, it must be easy to manufacture.

SUMMARY OF THE INVENTION

It is accordingly the object of this invention to provide a manually operable sweeping-type printing apparatus which is easy to manufacture, is small enough to be comfortably held by any user, and can print data of a high print quality, regardless of the level of skill of the operator.

According to the present invention, there is provided a manually operable sweeping-type printing apparatus which comprises:

housing;

supporter incorporated within said housing;

roller rotatably attached to said supporter, and capable of contacting a recording medium positioned outside said housing, for rotating when said housing is moved across the recording medium;

printer coupled to said supporter, for printing data on the recording medium;

distance-detector coupled to said supporter, for generating a signal every time said housing is moved a predetermined distance with respect to the recording medium;

electric circuit mounted on at least one of said housing and said supporter, for operating said printing means in response to the signal output from said distance-detector.

Since the roller, the printer, and the distancedetector are coupled to the supporter, they can be simultaneously incorporated into the housing. Hence, the printing apparatus of the present invention can be assembled with a higher productivity than the conventional apparatus whose internal components must be incorporated, one by one, into the housing, and then are located at appropriate positions within the housing.

DETAILED DESCRIPTION OF THE PREFERRED EMBODIMENTS

Figure 1:
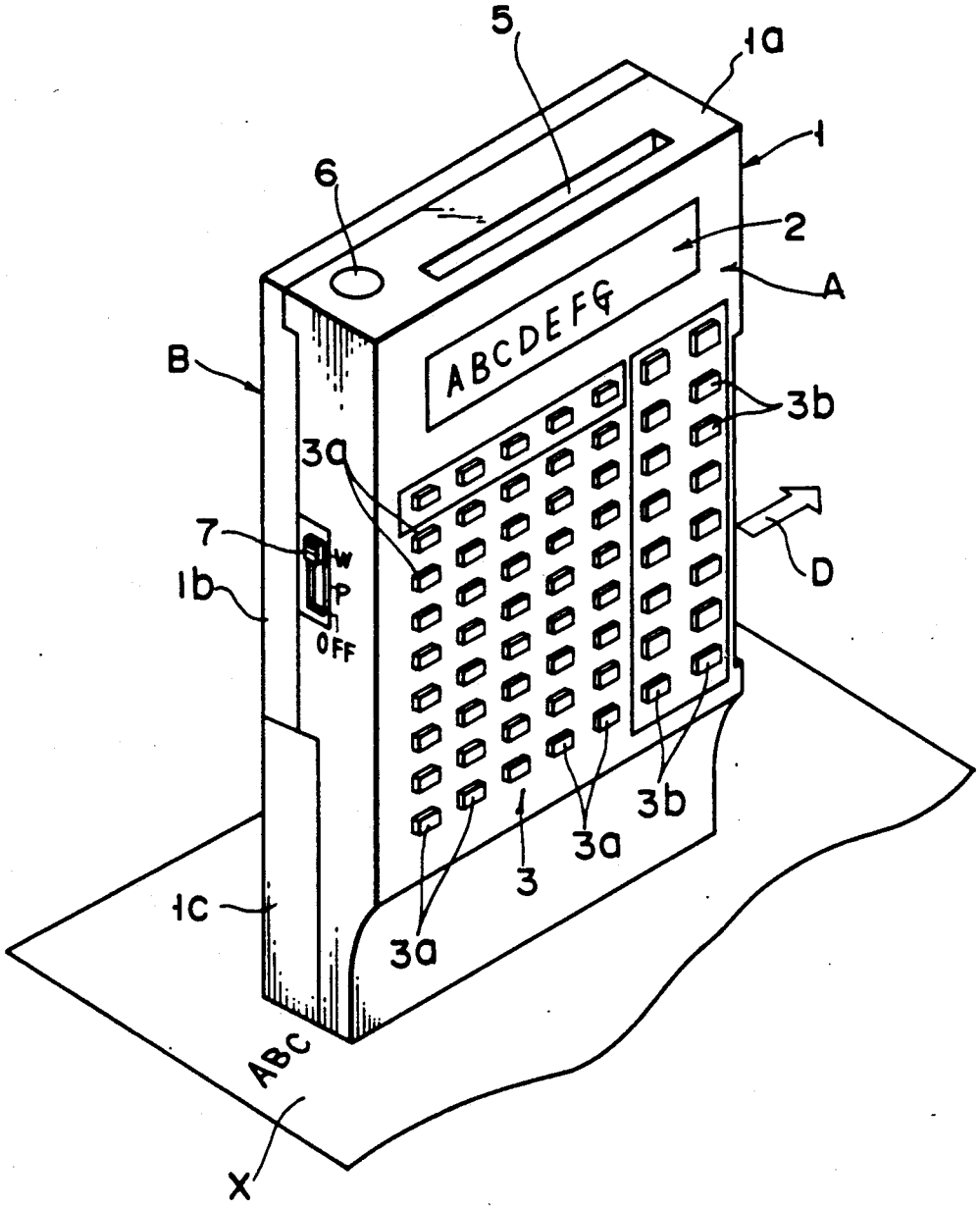
FIG. 1 is a perspective view, showing an outer appearance of a manually operable sweeping-type printing apparatus according to the present invention.

An embodiment of the present invention will be described with reference to FIG. 1 through FIG. 8. This embodiment is a hand-held word processor having the outer appearance illustrated in FIG. 1. As is shown in FIG. 1, the printing apparatus comprises housing 1 in the form of a rectangular box, display section 2 formed on the front of housing 1, and input section 3 formed also on the front of housing 1. Housing 1 is small enough that it can be held by any user. Input section 3 has a number of character keys 3 which are arranged in rows and columns, and control keys 3*b* arranged in two columns. Control keys 3*b* include data-selecting keys and a print-repeating key.

Figure 2:
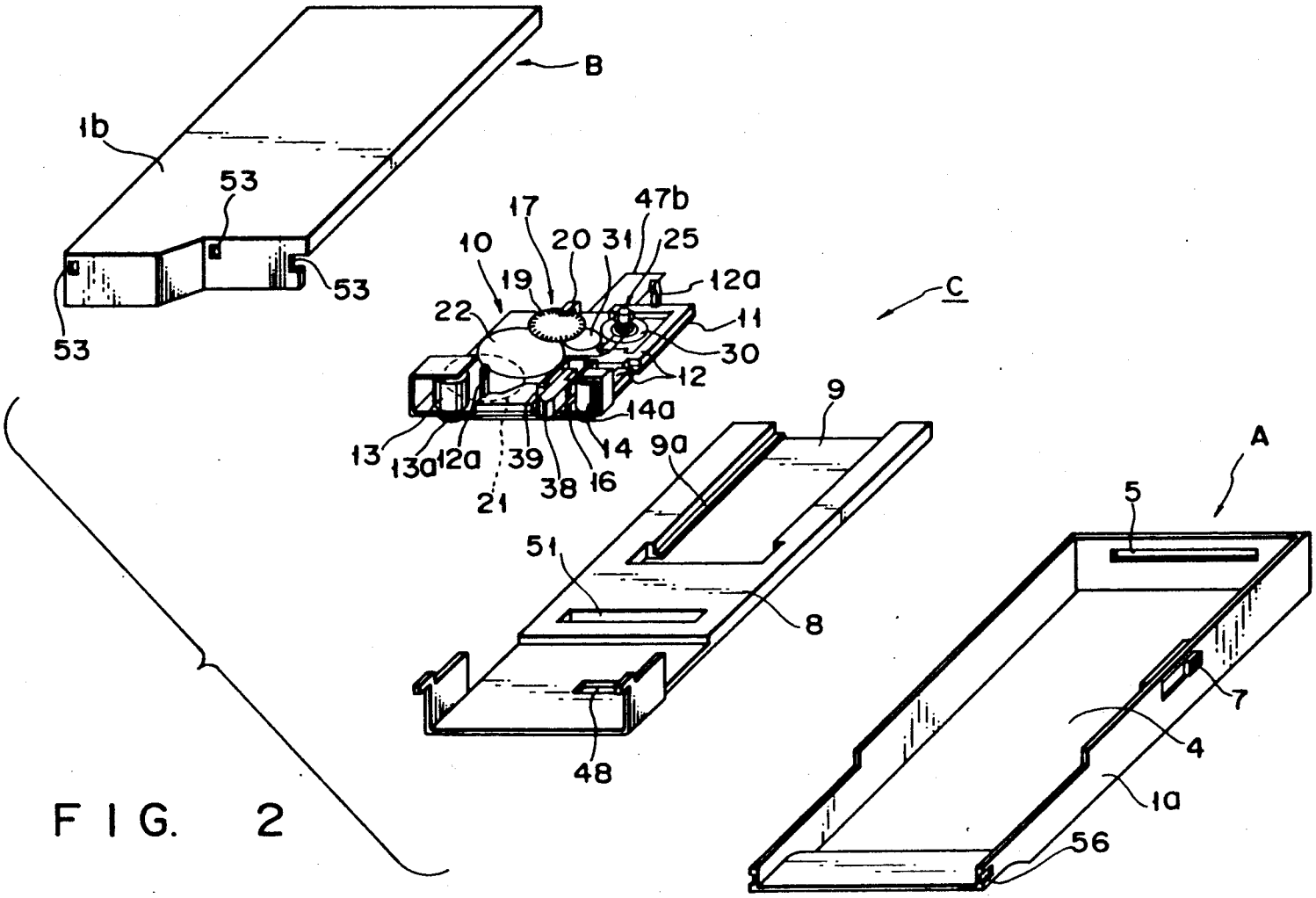
FIG. 2 is an exploded view of the printing apparatus shown in FIG. 1.

As is shown in FIG. 2, the hand-held word processor comprises front block A, rear block B, and center block C sandwiched between blocks A and B. Front block A and rear block B constitute housing 1.

Block A comprises front case 1*a* forming the front of housing 1, display section 2 attached to the outer surface of case 1, input section 3 also attached to the outer surface of case 1*a*, and main circuit board 4 located in front case 1*a*. Card port 5 and connector port 6 (FIG. 1) are made in the upper wall of case 1*a*. A memory card can be inserted into the word processor via card port 5, and a connector for electrically connecting the commercial power supply to the battery (later described) set within the word processor by a connector port 6. Mode-selecting switch 7, which is a slide switch and functions as a power-supply switch, is attached to one of the opposing side walls of front case 1*a*. Print-start button (not shown), which is a switch, is attached to the other side wall of case 1*a*.

Rear block B comprises rear case 1*b* forming the back of housing 1, the rechargeable battery (not shown) set within rear case 1*b*, and a power-supply circuit board (not shown, either) located within rear case 1*b*. Rear case lb is shorter than front case 1*a*, and coupled to front case 1*a*, with its upper end aligned with the upper end of front case 1*a* and, thus, its lower end receding from the lower end of front case 1*a*.

Center block C is located within housing 1 comprised of front block A and rear block B. As is shown in FIG. 2, center block C comprises chassis 8, printing unit 10 attached to the lower end of chassis 8. Chassis 8 has card recess 9 extending from the upper end to the middle portion, for receiving a memory card (not shown) inserted into the word processor through port 5 cut in the upper wall of front case 1*a*. Card-guiding rails 9*a* are formed on the opposing sides of card recess 9.

Figure 3:
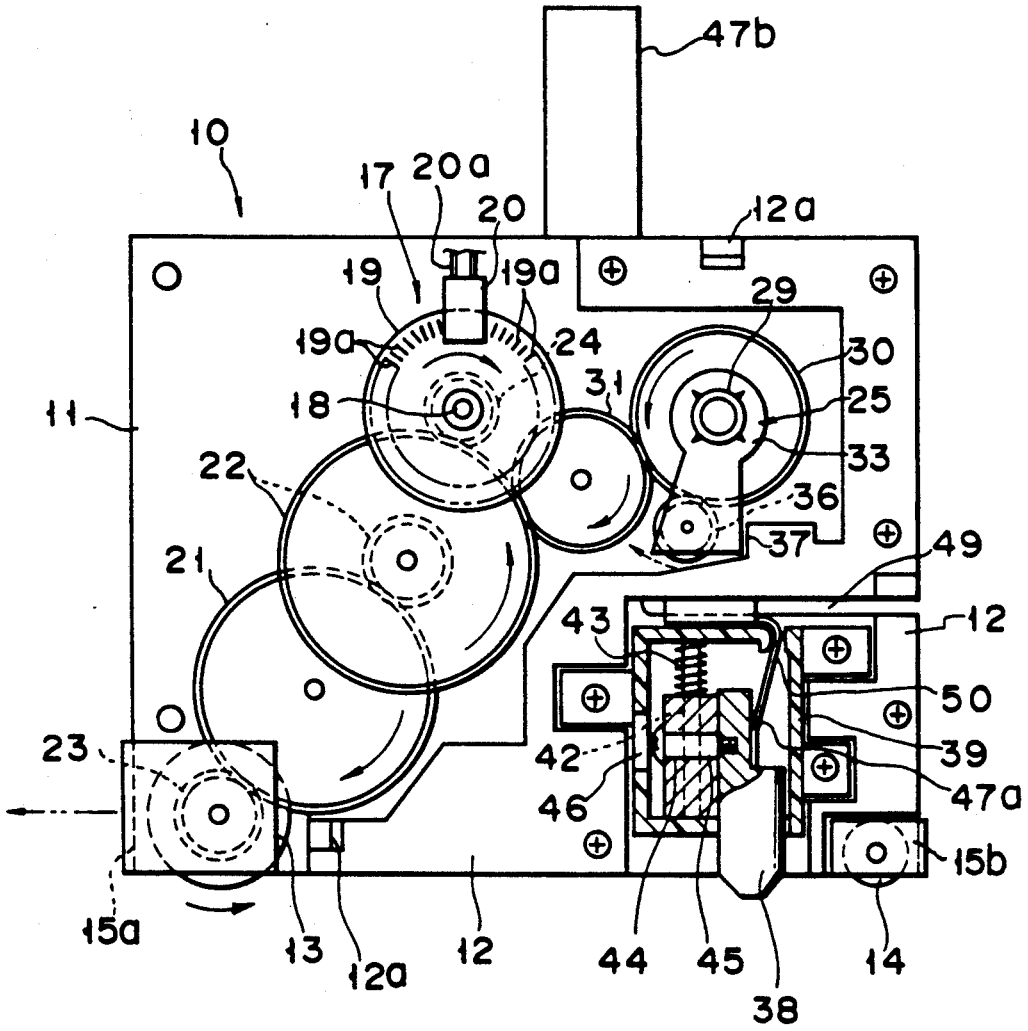
FIG. 3 is a diagram illustrating, in detail, the printing unit shown in FIG. 2.
Figure 4:
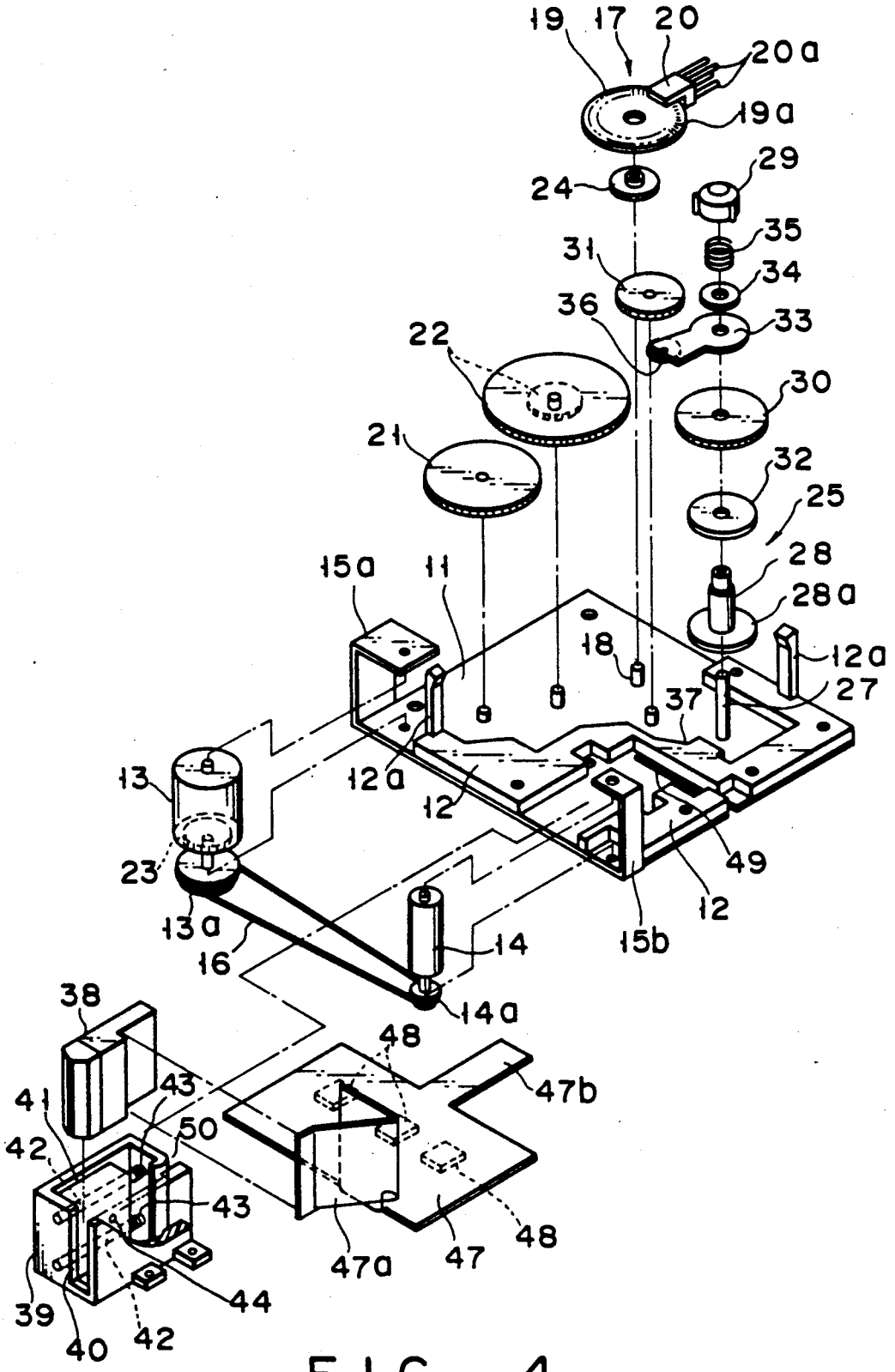
FIG. 4 is an exploded view of the printing unit shown in FIG. 3.
Figure 5:
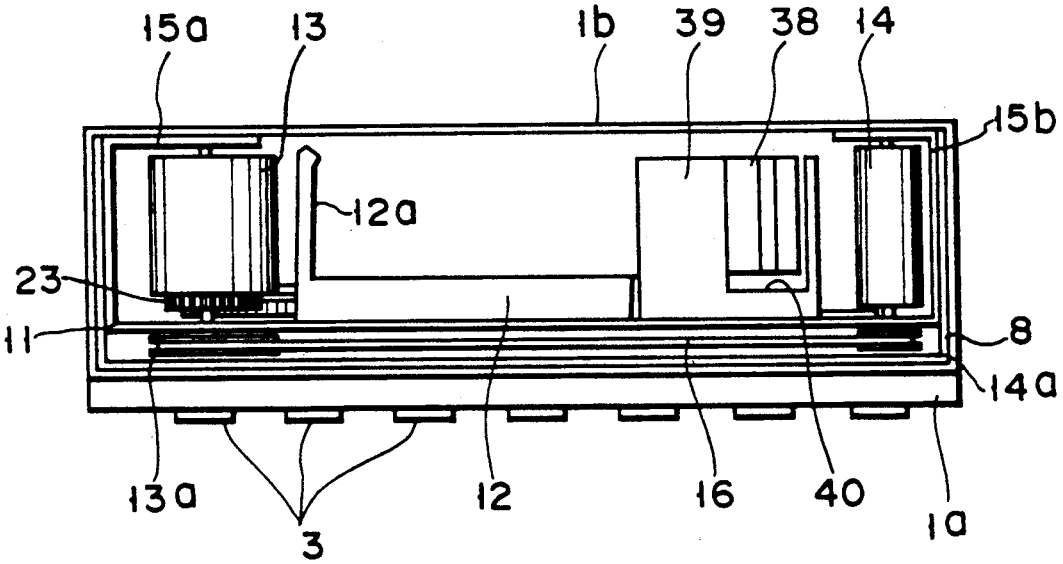
FIG. 5 is a bottom view of the printing apparatus shown in FIG. 1.

As is shown in FIGS. 3 to 5, printing unit 10 comprises base 11, cassette table 12, main roller 13, auxiliary roller 14, and roller supports 15*a* and 15*b*. Base 11 is a metal plate. Cassette table 12, which is made of a synthetic resin, is fastened to base 11 by means of screws. Rollers 13 and 14 are rotatably supported by supports 15*a* and 15*b* which ar provided at the lower end of base 11 and spaced part from each other. Rollers 13 and 14 are brought into contact with a sheet of recording paper in order to print data on the paper. Rollers 13 and 14 are made of material (such as hard rubber) which has a relatively large coefficient of friction and is comparatively rigid. Therefore, neither roller slips or is deformed noticeably while the word processor is printing data on the recording paper.

Rollers 13 and 14 are fixedly mounted on rotatable shafts. Pulleys 13*a* and 14*a* are fastened to the shafts of rollers 13 and 14, respectively. Pulleys 13*a* and 14*a* and located below base 11. Rubber belt 16 is wrapped around pulleys 13*a* and 14*a*, whereby one of rollers 13 and 14 is rotated whenever the other roller rotates in contact with the recording paper.

Printing unit 10 further comprises encoder 17 for detecting, from the rotation of main roller 13, the distance housing 1 has been moved across the recording paper. As is illustrated in FIGS. 2, 3, and 4, encoder 17 comprises pivot 18 projecting from base 11, disc 19 rotatably mounted on pivot 18, and rotation detector 20 for detecting the angle of rotation of disc 19. A number of radial slits 19*a* are cut in the circumferential edge of disc 19 and spaced apart at regular intervals. Rotation detector 20 consists of a support and two parallel arms fastened, at one end, to the support. A light-emitting element (e.g., a light-emitting diode) is mounted on the first arm, while a light-receiving element (e.g., a phototransistor) is mounted on the second arm and opposes the light-emitting element. Detector 20 is positioned such that the circumferential edge of disk 19 is interposed between the arms. The support of rotation detector 20 is attached to base 11. Detector 20 has output lead 20*a* which is connected to main circuit board 4.

First gear 21 meshes with drive gear 23 fastened to one end of main roller 13. Second gear 22 meshes with first gear 21 and driven gear 24 fastened to disc 19. Hence, as roller 13 rotates in contact with recording paper, first gear 21 and second gear 22 are rotated, thereby rotating disc 19. As disc 19 is rotated, radial slits 19*a* sequentially come into alignment with the light beam emitted from the light-emitting element, whereby the light beam passes slits 19*a* and reaches the light-receiving element. Every time the light-receiving element receives the light beam, rotation detector 20 outputs an electric pulse. Therefore, the pulse signal generated by rotation detector 20 represents the rotation angle of disc 19 and, hence, the distance for which housing 1 has been moved across the recording paper. Roller 13, disc 19, and gears 21 to 24 are designed such that encoder 17 produces one pulse every time housing 1 is moved ⅛ mm across the paper.

Figure 6A:
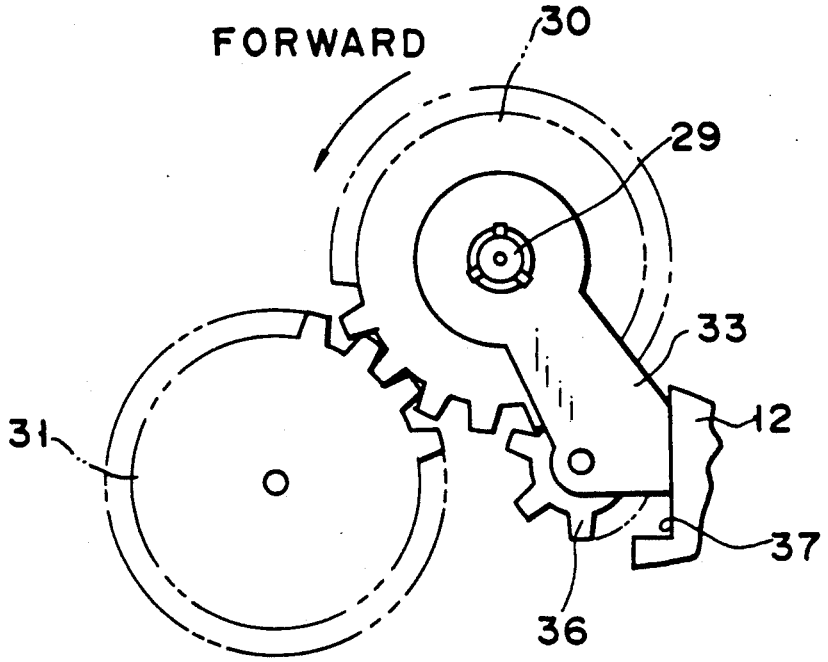
FIGS. 6A and 6B are enlarged views showing the ink ribbon take-up shaft incorporated in the printing unit shown in FIG. 3.
Figure 6B:
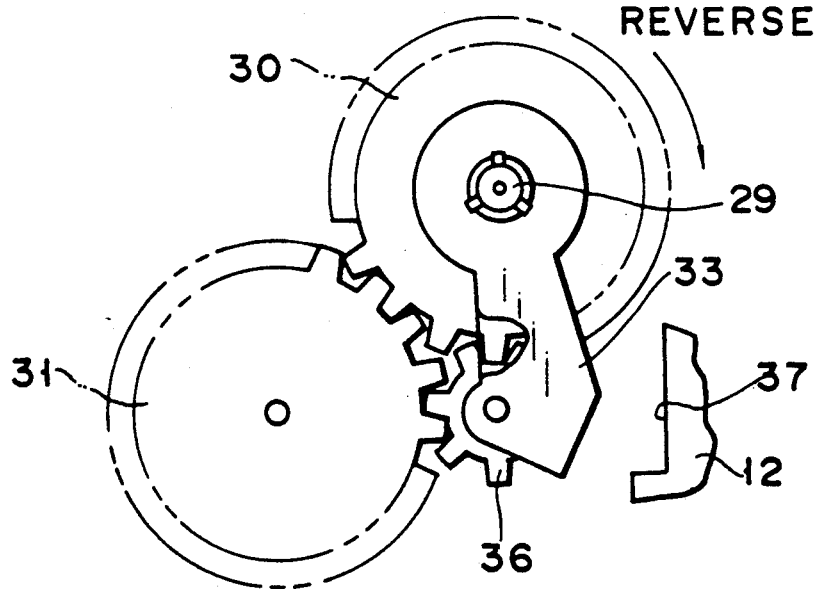

As is shown in FIG. 3 and 4, printing unit 10 has ribbon take-up shaft 25 for rotating the take-up spool incorporated in ribbon cassette 26 inserted in housing 1 and mounted on the single rigid base 11. Take-up shaft 25 comprises hollow shaft 28 rotatably mounted on pin 27 projecting upward from base 11 and having flange 28*a* integrally formed with its lower end, and spool-retaining member 29 secured to the upper end of shaft 28. Drive gear 30 is rotatably mounted on hollow shaft 28 and meshes with third gear 31 which in turn meshes with second gear 22. Friction disc 32 having a center hole is rotatably mounted on shaft 28 and interposed between flange 28*a* and drive gear 30. Rotary plate 33 and washer 34 are loosely mounted on shaft 28 and interposed between member 29 and drive gear 30. Coil spring 35 is mounted on shaft 28 and interposed between spool-retaining member 29 and washer 34. Coil spring 35 pushes down washer 34, rotary plate 33, drive gear 30, and friction disc 32 onto flange 28*a* of hollow shaft 28, thereby fastening washer 34, plate 33, gear 30, and disc 32 together. Rotary plate 33 has an arm extending outwardly. Gear 36 is pivotally coupled to this arm. This gear 36 meshes with drive gear 30 as is shown in FIGS. 6A and 6B, and prevents ribbon take-up shaft 25 from rotating in the direction opposite to ribbon takeup direction when housing 1 is moved in the direction opposite to the predetermined printing direction.

As main roller 13 rotates in contact with the recording paper, third gear 31 meshing with second gear 22 is rotated. Since third gear 31 meshes with drive gear 30, ribbon take-up shaft 25 is rotated. Since gear 30 is in friction contact with friction disc 32, and disc 32 in turn is frictionally connected to flange 28*a* of shaft 28, shaft 28 and spool-retaining member 29 are rotated. As drive gear 30 rotates in the direction as is shown in FIG. 6A, friction plate 33 is rotated, whereby gear 36, which is pivotally coupled to plate 33, is moved around the circumference of gear 30.

It will now be explained how gear 36 prevents ribbon take-up shaft 25 from rotating in the direction opposite to ribbon take-up direction. When housing 1 is moved in the direction of the arrow (two-dot, one-dash line) shown in FIG. 3, i.e., the printing direction, main roller 13, which contacts with the recording paper, rotates in the direction of the arrow (solid line) shown in FIG. 3. As a result, gears 21, 22, 30, and 31 rotate in the directions specified by arrows in FIG. 3. As gear 30 rotates in the forward direction as is shown in FIG. 6A, ribbon take-up shaft 25 rotates in the take-up direction. In this case, rotary plate 33 rotates in the same direction as drive gear 30 until it abuts against stopper 37 formed on one side of cassette table 12. Plate 33 is thus stopped, but gear 30 slips on plate 33 and keeps on rotating. Grease is applied between rotary plate 33 and washer 34, and plates 33 and washer 34 slips on each other. Shaft 25 therefore rotates as gear 30 rotates. When housing 1 is moved in the direction opposite to the printing direction, main roller 13 is rotated in the opposite direction, whereby gears 21, 22, 30 and 31 are rotated in the directions opposite to those specified in FIG. 3. As gear 30 rotates in the reverse direction as is shown in FIG. 6B, rotary plate 33 is rotated in the same direction, thereby putting gear 36 into engagement with third gear 31. The moment gear 36 comes into engagement with gear 31, these gears 30 and 36 are stopped. Ribbon take-up shaft 25, to which gear 31 is fastened, is therefore stopped, and disc 19 of encoder 17 is stopped. At the same time, main roller 13 can no longer rotate and will slide on the recording paper if housing 1 is further moved in the direction opposite to the printing direction.

As is shown in FIGS. 3 to 5, printing unit 10 further includes print head 38 and head holder 39 located below base 11 and fastened to base 11 by means of screws and holding print head 38. Print head 38 is a thermal print head having 4 heating elements arranged in one column, and designed to print data in a density of, for example, 8 dots/mm. Head holder 39 is shaped like a box and has opening 40 in the bottom, through which head 38 can protrude. It contains head mount 41 to which print head 38 is attached. Head mount 41 is slidably supported by two parallel guide rods 42 vertically extending within head holder 39. Hence, print head 38 can be moved up and down. Head mount 41 is biased downwardly by coil springs 43 mounted on guide rods 42 and interposed between head mount 41 and the top of holder 39. Head mount 41 has horizontal hole 44. Print head 38 is incorporated within holder 39, except for its front portion protruding via opening 40 of holder 39. Print head 38 is attached to mount 41 by means of bolt 45, with its back contacting the head mount. As is shown in FIG. 3, bolt 45 extends through hole 44 and is threaded in a screw hole cut in the back of mount 41. Head holder 39 has hole 46 through which bolt 45 has been inserted into head holder 39. Bolt 45 is loosely fitted in hole 44 of head mount 41, so that print head 38, which is fastened to mount 41, can rotate around the axis of bolt 45.

Base 11 of printing unit 10 is mounted on the lower end portion of chassis 8 and coupled thereto by means of screws. As is shown in FIG. 4, circuit board 47 is laid on the back of chassis 8. Circuit board 47 has a flexible substrate within which a head driver circuit is formed. LSI chips 48 are attached to circuit board 47 Connector sections **47*a* and 47*b* extend from the lower and upper ends of circuit board 47. Connector section 47*a* extends through slits 48 and 49 made in chassis 8 and base 11, respectively. It further extends through slit 50 made in head holder 39 and is coupled to print head 38 held within holder 39. Connector section 47*b* extends through opening 51 made in chassis 8, protrudes upward from chassis 8, and is connected to the connector (not shown) which in turn is connected to main circuit board 4**.

As can be understood from the above, center block C comprises chassis 8, printing unit 10 attached to this chassis and including rollers 13 and 14, encoder 17, ribbon take-up shaft 25, the gear mechanism for driving encoder 17 and shaft 25, and circuit board 47 having a built-in head driver circuit. Center block C is placed within front case la, and is positioned such that both rollers 13 and 14 slightly protrude downwardly from the lower end of front case la. Chassis 8 is fastened to front block A by means of screws.

Housing 1 has been assembled by combining front block A having center block C fastened thereto, and rear block B, and then by coupling front case la and rear case **1*b* together. The power-supply circuit board of rear block B, and the circuit board (47) of center block C are coupled to main circuit board 4** of front block A.

Figure 7:
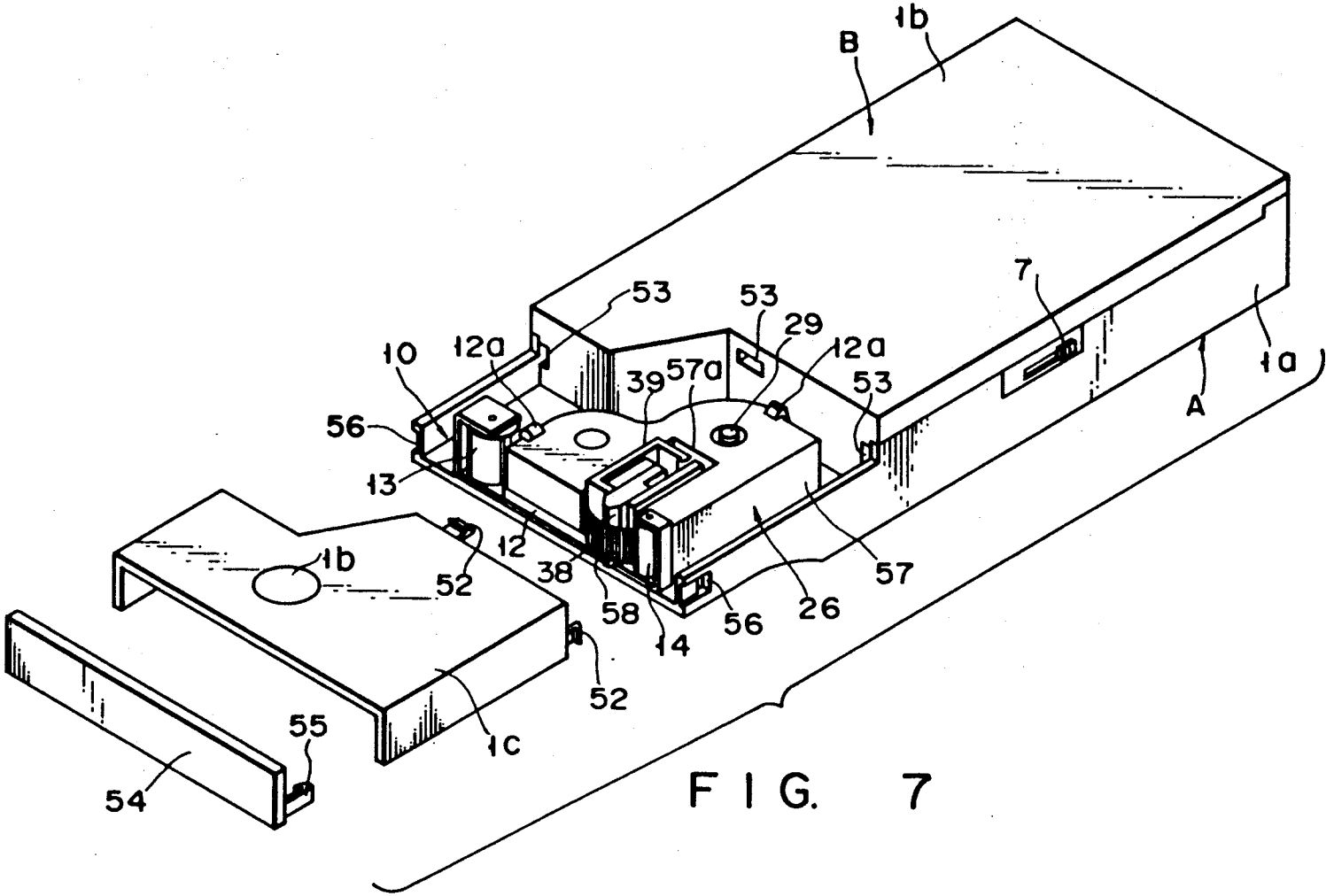
FIG. 7 is an exploded view of the printing apparatus containing a ribbon cassette, as viewed from the back.

As is shown in FIG. 7, printing unit 10 included in center block C is located at the lower end of rear case **1*b* and covered by detachable cover 1*c*. Cover 1*c* has claws 52 protruding from the upper end. When cover 1*c* is formed onto the lower end of rear case 1*b*, these claws 52 fit into holes 53 cut in the lower end of rear case 1*b*. Cover 1*c* is thereby attached to housing 1, with its surface positioned flush with the outer surface of rear case 1*b*. Cover 1*c* can be detached from housing 1 when it is pulled downwardly from rear case 1*b*. Cover 1*c* has window 1*d* through which an operator can see the ribbon-feeding spool incorporated within the ribbon cassette 26, thereby to know how much ribbon remains unused. Protective cover 54 is detachably connected to housing 1, thus covering print heat 38 and rollers 13 and 14. Protective cover 54 has two elastic claws 55 protruding from its ends and fitted in recesses 56 cut in the lower ends of front case la. As long as protective cover 54 is coupled to housing 1, it places print head 38 within housing 1, despite the force of coil springs 43 biasing head 38 downwardly. When protective cover 54 is detached from housing 1 in order that printing unit 10 prints data on the recording paper, print head 38 is pushed down by springs 43 and thus protrudes from the lower end of housing 1**.

As is shown in FIG. 7, ribbon cassette 26 comprises case 57, a ribbon take-up spool (not shown) contained in case 57, a ribbon-feeding spool (not shown, either) contained in case 57, and ribbon 58 wound partly around the take-up spool and partly around the feeding-spool. Case 57 is made of transparent synthetic resin, and has large notch **57*a* in which head holder 39 can be placed. That portion of ribbon 58 which extends between the spools is positioned in notch 57*a*; it can be wrapped around print head 38**.

Ribbon cassette 26 is set on cassette table 12 of printing unit 10 in the following way. First, protective cover 54 and cover **1*c* are detached from housing 1. Then, cassette 26 is placed on table 12. When cassette 26 is placed on table 12, head 38 is placed in notch 57*a* and that portion of ribbon 58 is wrapped around print head 38. Finally, the position of cassette 26 is adjusted until it is held at a predetermined position by two claws 12*a* protruding from cassette table 12. Since disc 19, gears 21, 22, 30 and 31, and rotary plate 33 are arranged below the upper surface of cassette table 12, ribbon cassette 26 can be set onto table 12** without coming into contact with these members.

Figure 8:
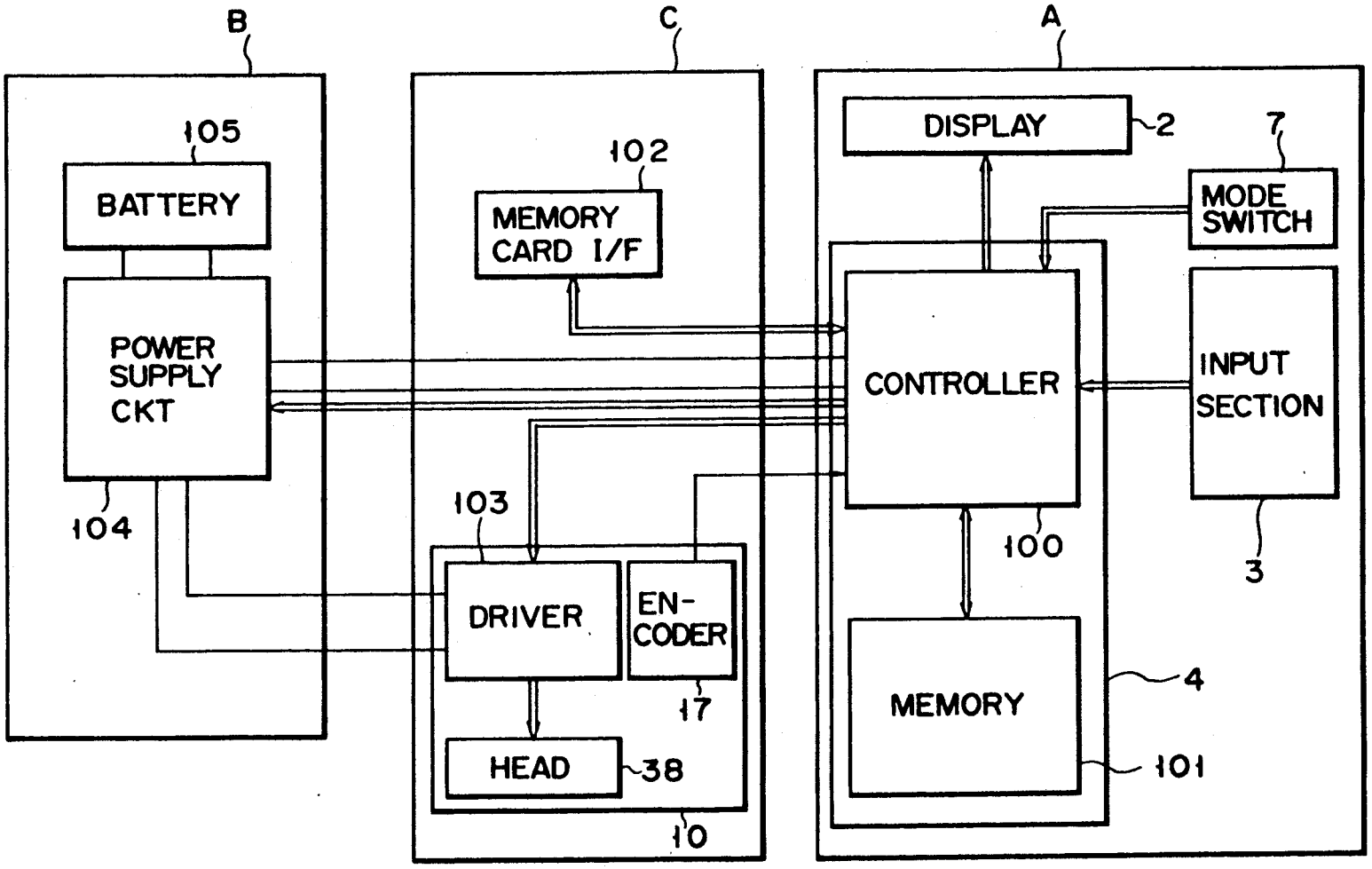
FIG. 8 is a block diagram showing the electric circuit incorporated in the printing apparatus shown in FIG. 1.

FIG. 8 is a block diagram showing the electric circuit incorporated in the word processor. As is shown in this figure, controller 100 and memory 101 are provided on main circuit board 4. Controller 100 controls the other electric components of the circuit in accordance with the signals output by input section 3, mode-selecting switch 7, encoder 17, or the like. Memory 101 is used to store, under the control of controller 100, the character data input by operating input section 3.

Controller 100 is connected to memory card interface 102 and head driver 103, both incorporated in center block C. Controller 100 controls the datawriting into, and the data-reading from, a memory card (not shown) electrically connected to memory card interface 102. Further, controller 100 outputs character pattern data to head driver 103 in accordance with the character data stored in memory 101 or the memory card, and a print start instruction causing head driver 103 to start driving print head 38, so as to print the character data in synchronism with the pulse signal output by encoder 17.

Head driver 103 outputs print data, line by line, to print head 38 in accordance with the character pattern data supplied from control circuit 100, and starts driving print head 38 in response to the print start instruction.

Power supply circuit 104 and battery 105 are incorporated in rear block B. Electric power is supplied from battery 105 to power supply circuit 104. Circuit 104 supplies the electric power to the components provided in front block A and center block C.

When mode-selecting switch 7 is moved to position W, as is shown in FIG. 1, the word processor is set in a word-processing mode (W). Then, character data can be input by operating input section 3, and the data thus input can be written into memory 101. When mode-selecting switch 7 is moved to position P, the word processing is set in a printing mode. Then, the character pattern data which corresponds to the character data stored in memory 101 or the memory card connected to interface 102, is supplied to print head 38. Head 38 prints the character data in synchronism with the pulse signal output by encoder 17 as housing 1 moved in the printing direction.

It will now be explained how the word processor is operated. The word processor is operated in the same way as the known word processors. That is, the input section 3 is operated, thereby writing character data into memory 101 and simultaneously displaying the data by means of display section 2. When necessary, the character data is read from memory 101 and printed by print head 38 on the recording paper.

More specifically, to input character data into memory 101, the operator moves mode-selecting switch 7 to the position W, whereby the word processor is set in the word-processing mode. He or she operates input section 3, thus inputting desired character data. This data is displayed by display section 2, and is written into memory 101 under the control of controller 100.

In order to print the character data on a sheet of recording paper, the operator moves mode-selecting switch 7 to the position P, whereby the word processor is set in the printing mode. He or she detaches protective cover 54 from housing 1, thus exposing rollers 13 and 14 and print head 38. The operator holds housing 1 and presses rollers 13 and 14 and print head 38 onto the recording paper X. In this condition, coil springs 43 are compressed, and their reaction keeps head 38 in contact with recording paper X. Then, the operator moves housing in the printing direction indicated by arrow D (FIG. 1), keeping rollers 13 and 14 and print head 38 in contact with the paper X. Hence, rollers 13 and 14 are rotated. As main roller 13 is thus rotated, encoder 17 outputs a pulse signal consisting of pulses, each of which is generated every time main roller 13 is rotated by the predetermined angle. This pulse signal is supplied to controller 100. Controller 100 reads the character data from memory 101 or the memory card. In accordance with the character data, the controller 100 generates character pattern data. The character pattern data is supplied from controller 100 to head driver 103. In response to the pulse signal, head driver 103 outputs print pattern data to print head 38, line by line. Print head 38 pints the character data on the paper X in accordance with the print data, by using ribbon 58 which is being taken up around the take-up spool of ribbon cassette 26 as ribbon take-up shaft 25 rotates.

Print head 38 is located between main roller 13 and auxiliary roller 14 which are spaced apart in the printing direction (i.e., the arrow D), and are biased by coil springs 43, thus slightly protruding outward with respect to rollers 13 and 14. As long as both rollers 13 and 14 remain in contact with the recording paper X, head 38 is automatically pressing ribbon 58 onto the paper X with a constant pressure. Further, since print heat 38 is rotatably supported on head table 41 of head holder 39, its entire front surface remains in contact with the paper X even if housing 1 is tilted frontward or rearward while being moved across the recording paper X. Therefore, the character data can be completely printed on the paper X.

As has been described, printing unit 10 comprises rollers 13 and 14, encoder 17, ribbon take-up shaft 25, print head 38, and the gear mechanism, which rotates disc 19 and shaft 25 as roller 13 is rotated, all mounted on the same base 11. Therefore, rollers 13 and 14, encoder 17, shaft 25, head 38, and the gear mechanism can be simultaneously incorporated into housing 1. Further, since the word processor comprises front block B which includes front case la having display section 2, input section 3, and main circuit board 4; center block C which includes chassis 8 and printing unit 10 attached to chassis 8; and rear block B which includes case lb containing battery 101 and the power-supply circuit board (not shown), the components of printing unit 10 (i.e., rollers 13 and 14, encoder 17, ribbon take-up shaft 25, print head 38, and the gear mechanism) can be incorporated into housing 1 merely by fastening blocks A, B, and C together. Still further, housing 1 having display section 2, input section 3 and containing battery 101 and circuit board 4 can be assembled merely by connecting front block A and rear block B.

Therefore, the word processor according to this invention can be more easily assembled, and thus be manufactured with a greater productivity than the conventional manually operable sweeping-type printing apparatus which has been assembled by incorporating the internal components, one by one, into the housing and then individually positioned therein.

As has been described, both disc 19 of encoder 17 and ribbon take-up shaft 25 are driven as main roller 13 is rotated, and roller 13 can be rotated by means of pulleys **13*a* and 14*a* and rubber belt 16 a auxiliary roller 14 rotates. Hence, even if main roller 13 does not contact a recording medium, head 38 can print data on the medium, provided auxiliary roller 14 is rotating in contact with the medium. Print head 38** can print data on the every edge of a thick recording medium, such as a notebook.

Figure 9A:
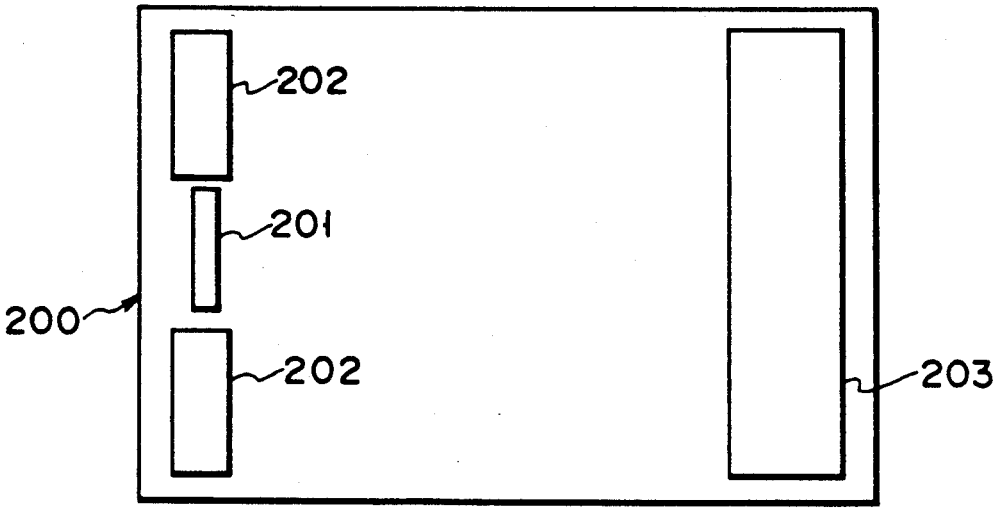
FIG. 9A shows a second embodiment, illustrating the positional relationship between a print head and rollers.
Figure 9B:
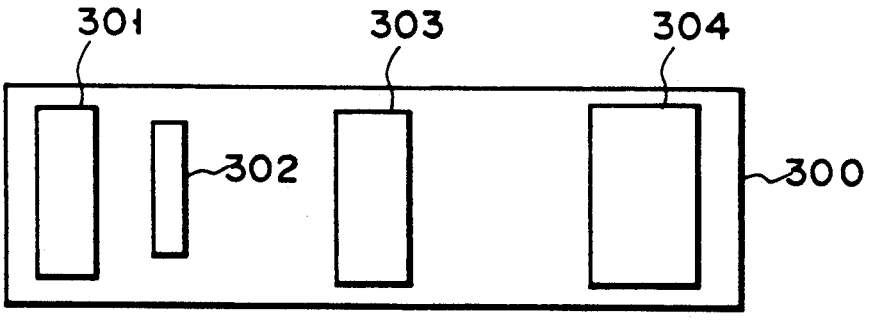
FIG. 9B shows a third embodiment, illustrating the positional relationship between a print head and rollers.

FIG. 9A shows a hand-held word processor according to a second embodiment of the present invention. This word processor has two auxiliary rollers 20 located at rear with respect to main roller 203, as is viewed in the printing direction. Auxiliary rollers 202 are coaxially arranged, and print head 201 is located between auxiliary rollers 202. FIG. 9B illustrates a hand-held word processor according to a third embodiment of the present invention. This word processor has two auxiliary rollers 301 and 303 and one main roller 304. First auxiliary roller 301, print head 302, second auxiliary roller 303, and main roller 304 are arranged in this order in the direction opposite to the printing direction. Also in the second and third embodiments, the print head can reliably contact a recording medium when the rollers contact the medium, since it is positioned between rollers.

What is claimed is:

1. A hand-held electronic printing apparatus, comprising:

housing means for containing components of the apparatus and for enabling the appartaus to be manually swept across a recording medium, said housing means including at least two cases arranged to be joined to one another;

a chassis including a single rigid base mounted in a mounting section of one of said cases of said housing means;

roller means fixed directly to said single rigid base for rotational movement and being adapted to protrude from said housing means to contact said recording medium, said roller means rotating when said housing means is swept across said recording medium;

an ink-ribbon detachably mounted directly to said single rigid base and being arrange to contract said recording medium;

ink-ribbon winding means fixed directly to said single rigid base for winding said ink-ribbon;

encoder means including an encoder disk fixed directly to said single rigid base, for generating a signal every time said housing means is swept over a predetermined distance with respect to said recording medium;

rotation-transmitting means fixed directly to said single rigid base, for transmitting rotation of said roller means to said ink-ribbon winding means and to said encoder disk; and printing means provided in said housing means and for contacting said ink-ribbon, for transmitting ink of said ink-ribbon onto said recording medium;

wherein critical rotating components of the apparatus are fixed directly to said single rigid base for incorporation together within the housing means data storage means;

key input means mounted on said housing means for inputting data to said data storage means; and, display means mounted on said housing means for displaying said data stored in said data storage means.

2. A hand-held electronic printing apparatus of claim 1, wherein said printing means is mounted on said chassis.

3. A hand-held electronic printing apparatus of claim 1, wherein said rotation-transmitting means includes means for transmitting the rotation of said roller means to said ink-ribbon winding means when said housing means is swept in a forward direction, and for preventing the reverse direction winding of said ink-ribbon winding means.

4. A hand-held electronic printing apparatus of claim 3, wherein said rotation-transmitting means includes:

gear means for transmitting the rotation of said roller means to said ink-ribbon winding means; and stopper means for allowing said gear means to rotate when said housing means is swept in the forward direction, and for preventing said gear means from rotating when said housing means is swept in the reverse direction.

5. A hand-held electronic printing appartaus of claim 4, wherein:

said gear means includes a plurality of gears meshing with one another; and said stopper means includes a movable gear in mesh with one of said gears of said gear means and which is meshable with both said one gear and other gears of said gear means, and which meshes with said one gear of said gear means when said housing means is swept in the reverse direction.

6. A hand-held electronic printing apparatus of claim 1, further comprising electronic circuit means mounted on at least one of said housing means and said chassis, for operating said printing means in response to a single output from said encoder means.

7. A hand-held electronic printing apparatus of claim 6, wherein said electronic circuit means includes;

said data storage means mounted to said housing means for storing said data to be printed; and data processing means mounted on said housing means, for supplying said data from said data storage means to said printing means in accordance with said data supplied from said data storage means.

8. A hand-held electronic printing apparatus of claim 6, wherein said electronic circuit means includes:

data storing means mounted on said housing means for storing data to be printed;

printing control means mounted on said chassis and coupled to said data storing means, for controlling said printing means, so as to print said data stored in said data storing means; and data processing means mounted on said housing means, for supplying said data to be printed, from said data storing means to said printing control means.

9. A hand-held electronic printing apparatus of claim 8 further comprising:

power supplying means mounted on said housing means, for supplying electric power to said electronic circuit means.

10. A hand-held electronic printing apparatus, comprising:

housing means for containing components of the apparatus and for enabling the apparatus to be manually swept across a recoding medium, said housing means including at least two cases arranged to be joined to one another;

a single rigid chassis block mounted to a mounting section of one of said cases of said housing means, said single rigid chassis block including:

roller means fixed directly to said single rigid chassis block for rotational movement and being adapted to protrude from said housing means to contact said recording medium, said roller means rotating when said housing means is swept across said recording medium;

ink-ribbon means including a take-up shaft mounted directly to said single rigid chassis block, and an ink-ribbon detachably provided on said take-up shaft, for contacting said recording medium and for supplying ink to be printed;

encoder means including an encoder disk mounted directly to said single rigid chassis block for generating a signal every time said housing means is swept over a predetermined distance with respect to said recording medium; and rotation-transmitting means mounted directly to said single rigid chassis block for transmitting rotation of said roller means to said take-up shaft and to said encoder disk; and printing means provided in said housing means and contacting said ink-ribbon, for transmitting ink of said ink-ribbon onto said recording medium;

wherein critical rotating components of the apparatus are fixed directly to said single rigid chassis block for incorporation together within the housing means data storage means;

key input means mounted on said housing means for inputting data to said data storage means; and, display means mounted on said housing means for displaying said data stored in said data storage means.

11. A hand-held electronic printing apparatus of claim 10, wherein said printing means is mounted on said chassis block.

12. A hand-held electronic printing apparatus of claim 10, wherein said rotation-transmitting means includes means for transmitting the rotation of said roller means to said take-up shaft when said housing means is swept in a forward direction, and for preventing the rotation of said roller means from being transmitted to said take-up shaft when said housing means is swept in a reverse direction.

13. A hand-held electronic printing apparatus of claim 12, wherein said rotation-transmitting means includes:

gear means for transmitting the rotation of said roller means to said take-up shaft; and stopper means for allowing said gear means to rotate when said housing means is swept in the forward direction, and for preventing said gear means from rotating when said housing means is swept in the reverse direction.

14. A hand-held electronic printing apparatus of claim 13, wherein:

said gear means includes a plurality of gears meshing with one another; and said stopper means includes a movable gear in mesh with one of said gears of said gear means and which is meshable with both said one gear and other gears, which meshes with said one gear of said gear means when said housing means is swept in the reverse direction.

15. A hand-held electronic printing apparatus of claim 10, further comprising electronic circuit means mounted on at least one of said housing means and said chassis block, for operating said printing means in response to a signal output from said encoder means.

16. A hand-held electronic printing apparatus of claim 15, wherein said electronic circuit means includes:

said data storage means mounted on said housing means, for supplying said data from said data storage means to said printing means; and driver means mounted on said chassis block, for driving said printing means in accordance with said data supplied from said data storage means.

17. A hand-held electronic printing apparatus of claim 15 wherein said electronic circuit means includes;

data storing mean mounted on said housing means for storing data to be printed;

printing control means mounted on said chassis block and coupled to said data storing means, for controlling said printing means so as to print said data stored in said data storing means; and data processing means mounted on said housing means, for supplying said data to be printed, from said data storing means to said printing control means.

18. A hand-held electronic printing apparatus of claim 17, further comprising:

power supplying means mounted on said housing means, for supplying electric power to said electronic circuit means.

* * * * *

UNITED STATES PATENT AND TRADEMARK OFFICE

CERTIFICATE OF CORRECTION

PATENT NO. : 5,024,541

DATED : June 18, 1991

INVENTOR(S) : TSUKADA et al

It is certified that error appears in the above-identified patent and that said Letters Patent is hereby corrected as shown below:

Title page:

Section [30] Foreign Application Priority Data:

Change "63-57515[U]" to --62-57515[U]--
Change "63-58649[U]" to --62-58649[U]--
Change "63-58652[U]" to --62-58652[U]--
Change "63-109701" to --62-109701--
Change "63-67931[U]" to --62-67931[U]--
Change "63-67932[U]" to --62-67932[U]--

Section [56] References Cited, under "U.S. PATENT DOCUMENTS", insert:

--3,767,020 10/1973 Rowe.....400/88--
--4,611,246 9/1986 Nihei....358/256--

Left column, change last USP "4,461,150" to --4,641,150--.

Signed and Sealed this

Sixteenth Day of March, 1993

*Attest:*

STEPHEN G. KUNIN

*Attesting Officer*

*Acting Commissioner of Patents and Trademarks*